US009290829B2

(12) United States Patent
Yi et al.

(10) Patent No.: US 9,290,829 B2
(45) Date of Patent: Mar. 22, 2016

(54) ALLOYS, BULK METALLIC GLASS, AND METHODS OF FORMING THE SAME

(75) Inventors: Li Yi, Singapore (SG); Irene Lee, Singapore (SG); Dong Wang, Singapore (SG)

(73) Assignee: National University of Singapore, Singapore (SG)

( * ) Notice: Subject to any disclaimer, the term of this patent is extended or adjusted under 35 U.S.C. 154(b) by 0 days.

(21) Appl. No.: 13/354,134

(22) Filed: Jan. 19, 2012

(65) Prior Publication Data

US 2012/0298264 A1 Nov. 29, 2012

Related U.S. Application Data

(63) Continuation of application No. 13/223,406, filed on Sep. 1, 2011, now abandoned, which is a continuation of application No. 11/994,298, filed as application No. PCT/SG2006/000180 on Jun. 28, 2006, now abandoned.

(60) Provisional application No. 60/695,259, filed on Jun. 30, 2005.

(51) Int. Cl.

| | |
|---|---|
| ***C22C 45/10*** | (2006.01) |
| ***C22C 16/00*** | (2006.01) |
| ***C22C 14/00*** | (2006.01) |
| ***C22C 30/02*** | (2006.01) |
| ***C22C 45/00*** | (2006.01) |

(52) U.S. Cl.

CPC ..... *C22C 16/00* (2013.01); *C22C 14/00* (2013.01); *C22C 30/02* (2013.01); *C22C 45/001* (2013.01); *C22C 45/10* (2013.01)

(58) Field of Classification Search

None

See application file for complete search history.

(56) References Cited

U.S. PATENT DOCUMENTS 5,567,251 A 10/1996 Peker et al.
5,711,363 A 1/1998 Scruggs et al.

(Continued)

FOREIGN PATENT DOCUMENTS

CN 1341771 A 3/2002
CN 01351192 A 5/2002

(Continued)

OTHER PUBLICATIONS

Yokoyama, Y. et al., "Cast structure and mechanical properties of Zr—Cu—Ni—Al bulk glassy alloys", Intermetallics, vol. 10, pp. 1113-1124, 2002.*

(Continued)

*Primary Examiner* — George Wyszomierski

(74) *Attorney, Agent, or Firm* — Kilpatrick Townsend & Stockton LLP

(57) ABSTRACT

An alloy having a formula $Zr_{100-x-u}$ $(Cu_{100-a}Ni_a)xAl_u$ wherein X, U and a are in atomic percentages wherein X is less than or equal to 48 and greater than or equal to 37, wherein U is less than or equal to 14 and greater than or equal to 3, and wherein a is less than or equal to ten and greater than or equal to 3. Methods of forming the alloy and bulk metallic glass comprising the alloy are also provided. The alloy and bulk metallic glass are useful in a wide number of applications which includes sports and luxury products, electronic goods, medical instruments, and military equipment.

4 Claims, 4 Drawing Sheets

(56) References Cited

U.S. PATENT DOCUMENTS

| | | | | |
|---|---|---|---|---|
| 5,735,975 | A | 4/1998 | Lin et al. | |
| 6,231,697 | B1 * | 5/2001 | Inoue et al. | 148/561 |
| 6,376,091 | B1 | 4/2002 | Croopnick | |
| 6,446,558 | B1 | 9/2002 | Peker et al. | |
| 6,521,058 | B1 | 2/2003 | Inoue et al. | |
| 6,652,673 | B1 * | 11/2003 | Inoue et al. | 148/403 |
| 6,682,611 | B2 * | 1/2004 | Zhang et al. | 148/561 |
| 6,771,490 | B2 | 8/2004 | Peker et al. | |
| 6,818,078 | B2 | 11/2004 | Kim et al. | |
| 6,843,496 | B2 | 1/2005 | Peker et al. | |
| 6,875,293 | B2 | 4/2005 | Peker et al. | |
| 6,887,586 | B2 | 5/2005 | Peker et al. | |
| 7,008,490 | B2 | 3/2006 | Peker | |
| 7,017,645 | B2 | 3/2006 | Johnson et al. | |
| 7,073,560 | B2 | 7/2006 | Kang et al. | |
| 7,293,599 | B2 | 11/2007 | Peker et al. | |
| 7,412,848 | B2 | 8/2008 | Johnson et al. | |
| 7,500,987 | B2 | 3/2009 | Bassler et al. | |
| 7,520,944 | B2 | 4/2009 | Johnson | |
| 7,560,000 | B2 | 7/2009 | Suzuki et al. | |
| 7,560,001 | B2 | 7/2009 | Peker | |
| 7,575,040 | B2 | 8/2009 | Johnson | |
| 7,582,172 | B2 | 9/2009 | Schroers et al. | |
| 7,588,071 | B2 | 9/2009 | Kang | |
| 7,618,499 | B2 | 11/2009 | Johnson et al. | |
| 7,621,314 | B2 | 11/2009 | Schroers | |
| 2003/0079813 | A1 | 5/2003 | Zhang et al. | |
| 2006/0076089 | A1 * | 4/2006 | Chang et al. | 148/403 |
| 2006/0149391 | A1 | 7/2006 | Opie et al. | |
| 2007/0003782 | A1 | 1/2007 | Collier | |
| 2007/0003812 | A1 | 1/2007 | Wende | |
| 2007/0226979 | A1 | 10/2007 | Paton et al. | |
| 2008/0185076 | A1 | 8/2008 | Schroers et al. | |
| 2009/0101244 | A1 | 4/2009 | Ogawa et al. | |
| 2009/0114317 | A1 | 5/2009 | Collier et al. | |
| 2009/0207081 | A1 | 8/2009 | Choi et al. | |

FOREIGN PATENT DOCUMENTS

| | | | |
|---|---|---|---|
| CN | 1351192 | A | 5/2002 |
| JP | 2000-256813 | A | 9/2000 |
| WO | 01/94054 | A1 | 12/2001 |
| WO | 2004/012620 | A2 | 2/2004 |

OTHER PUBLICATIONS

International Search Report corresponding to PCT/SG2006/000180 dated Jul. 28, 2006 (3 pages).

Wang et al., "Fatigue Behavior and Fracture Morphology of Zr50Al10Cu40 and Zr50Al10Cu3Ni10," *J. Intermetallics* (2004), 10(11):1219-1277.

Xing et al., "Glass Forming Ability of Bulk Zr56.6Cu17.3Ni12.5A19.6Ti4 Metallic Glass," *Chinese Journal of Nonferrous Metals*, (Feb. 2004) 14:2.

Office Action dated Mar. 11, 2013 corresponding to Korean Patent Application No. 10-2008-7002514 with English translation (6 pages).

Office Action dated Jan. 15, 2014 corresponding to Korean Patent Application No. 10-2008-7002514 with English translation (4 pages).

Final Rejection dated Apr. 19, 2014 corresponding to Korean Patent Application No. 10-2008-7002514 with English translation (4 pages).

Notice of Results of Re-Consideration Prior to Appeal (English translation, only) dated Sep. 23, 2014 corresponding to Korean Patent Application No. 10-2008-7002514 (3 pages).

* cited by examiner

80:20

85:15

90:10

95:5

ALLOYS, BULK METALLIC GLASS, AND METHODS OF FORMING THE SAME

CROSS REFERENCES TO RELATED APPLICATIONS

This application is a continuation of U.S. application Ser. No. 13/223,406, filed Sep. 1, 2011, which is a continuation of U.S. application Ser. No. 11/994,298, filed Nov. 17, 2008, which is a national stage application under 35 U.S.C. §371 of International Patent Application No. PCT/SG2006/000180, filed on Jun. 28, 2006, which claims priority to U.S. Provisional Patent Application No. 60/695,259, filed Jun. 30, 2005, each of which is incorporated by-reference-in its entirety herein.

TECHNICAL FIELD

The present invention relates generally to alloys, bulk metallic glass and methods of forming the same.

BACKGROUND

Alloys comprising an amorphous phase exhibit excellent material properties, such as elasticity, hardness and high tensile strength, and have shown potential to supersede purely crystalline alloys for certain functional and structural applications. In addition, such alloys generally have low densities and high strength-to-weight ratios when compared to purely crystalline alloys.

One type of alloy having an amorphous phase that is commonly used today is VITRELOY™ 1 from Amorphous Technologies International in Laguna Niguel, Calif., United States of America. VITRELO™ 1 is a zirconium-based alloy having a composition of $Zr_{41.2}Ti_{13.8}Cu_{12.5}Ni_{10}Be_{22.5}$. VITRELOY™ 1 is used extensively in a wide number of applications which includes sports and luxury products, electronic goods, medical instruments, and military equipment.

As VITRELO™ 1 contains beryllium, which is a carcinogen, strict precautions had to be taken during formation and processing of the alloy to avoid beryllium poisoning. This in turn results in high post-processing costs. Beryllium is also a costly material which makes the alloy expensive to produce.

There is therefore a need to provide an alloy or bulk metallic glass that overcomes or at least ameliorates one or more of the disadvantages described above.

SUMMARY

A first aspect provides an alloy having a formula:

$$(Zr,Ti)_{100-X-U}(Cu_{100-a}Ni_a)_XAl_U$$

wherein X, U and a are in atomic percentages in the following ranges:

$37 \leq X \leq 48$,
$3 \leq U \leq 14$, and
$3 \leq a \leq 30$.

In one embodiment, the formula is:

$$Zr_{100-X-U}(Cu_{100-a}Ni_a)_XAl_U$$

wherein X, U and a are in atomic percentages in the following ranges:

$37 \leq X \leq 48$,
$3 \leq U \leq 14$, and
$3 \leq a \leq 30$.

A second aspect provides an alloy having a formula:

$$[(Zr,Ti)_{100-X-U}(Cu_{100-a}Ni_a)_XAl_U]_{100-Z}Y_Z$$

wherein X, U, Z and a are in atomic percentages in the following ranges:

$37 \leq X \leq 48$,
$3 \leq U \leq 14$,
$0 < Z \leq 3$, and
$3 \leq a \leq 30$.

In one embodiment, the formula is:

$$[Zr_{100-X-U}(Cu_{100-a}Ni_a)_XAl_U]_{100-Z}Y_Z$$

wherein X, U, Z and a are in atomic percentages in the following ranges:

$37 \leq X \leq 48$,
$3 \leq U \leq 14$,
$0 < Z \leq 3$, and
$3 \leq a \leq 30$.

A third aspect provides a method of forming an alloy comprising the step of:

(a) melting a mixture comprising Zr, Cu, Ni and Al in defined amounts to produce a molten mixture having a composition defined by the formula:

$$(Zr,Ti)_{100-X-U}(Cu_{100-a}Ni_a)_XAl_U$$

wherein X, U and a are in atomic percentages in the following ranges:

$37 \leq X \leq 48$,
$3 \leq U \leq 14$, and
$3 \leq a \leq 30$; and (b) cooling the molten mixture to a solid to thereby form the alloy.

A fourth aspect of the present invention provides a method of forming an alloy comprising the steps of:

(a) melting a mixture comprising Zr, Cu, Ni, Al and Y in defined amounts to produce a molten mixture having a composition defined by the formula:

$$[(Zr,Ti)_{100-X-U}(Cu_{100-a}Ni_a)_XAl_U]_{100-Z}Y_Z$$

wherein X, U, Z and a are in atomic percentages in the following ranges:

$37X \leq 48$,
$3 \leq U \leq 14$,
$0 < Z \leq 3$, and
$3 \leq a \leq 30$; and (b) cooling the molten mixture to a solid to thereby form the alloy.

The alloy may also comprise incidental impurities.

A fifth aspect provides a bulk metallic glass having a composition of general formula:

$$(Zr,Ti)_{100-X-U}(Cu_{100-a}Ni_a)_XAl_U$$

wherein X, U and a are in atomic percentages in the following ranges:

$37 \leq X \leq 48$,
$3 \leq U \leq 14$, and
$3 \leq a \leq 30$.

A sixth aspect provides a method of making a bulk metallic glass comprising the steps of:

(a) melting a mixture comprising Zr, Cu, Ni and Al in defined amounts to produce a molten mixture having a composition defined by the formula:

$$(Zr,Ti)_{100-X-U}(Cu_{100-a}Ni_a)_XAl_U$$

wherein X, U and a are in atomic percentages in the following ranges:

$37 \leq X \leq 48$,
$3 \leq U \leq 14$, and
$3 \leq a \leq 30$.

(b) cooling the molten mixture to a solid to thereby form the bulk metal glass.

A seventh aspect provides an alloy consisting of Zr, Ti, Cu, Ni and Al metals, wherein said metals are present in said alloy according to the following formula:

$$(Zr,Ti)_{100-X-U}(Cu_{100-a}Ni_a)_XAl_U$$

wherein X, U and a are in atomic percentages in the following ranges:

$37 \leq X \leq 48$, $3 \leq U \leq 14$, and $3 \leq a \leq 30$.

An eighth aspect provides an alloy consisting of Zr, Ti, Cu, Ni, Al and Y metals, wherein said metals are present in said alloy according to the following formula:

$$[(Zr,Ti)_{100-X-U}(Cu_{100-a}Ni_a)_XAl_U]_{100-Z}Y_Z$$

wherein X, U, Z and a are in atomic percentages in the following ranges:

$37 \leq X \leq 48$, $3 \leq U \leq 14$, $0 < Z \leq 3$, and $3 \leq a \leq 30$;

A ninth aspect provides an alloy consisting of Zr, Ti, Cu, Ni, Al, wherein at least 50% of said alloy is in an amorphous phase.

A tenth aspect provides an alloy consisting of Zr, Ti, Cu, Ni, Al and Y, wherein at least 50% of said alloy is in an amorphous phase.

DEFINITIONS

The following words and terms used herein shall have the meaning indicated:

The term 'metallic glass' is to be interpreted broadly as a metal with a disordered atomic-scale or amorphous structure.

The term 'bulk metallic glass' or 'BMG' is to be interpreted broadly as a material having the properties of a metallic glass and a thickness of at least 1 mm.

The terms 'fully amorphous solid' or 'amorphous solid' are to be interpreted broadly as a material which is at least 95% (volume) of an amorphous phase. The terms 'amorphous matrix composite' or 'composite' are to be interpreted broadly as a material which is at least 50% (volume) of an amorphous phase.

The term 'incidental impurities' refers to any material that may be present in the raw materials used to produce the alloy. Incidental impurities include unavoidable impurities as well as avoidable impurities.

Unless specified otherwise, the terms "comprising" and "comprise", and grammatical variants thereof, are intended to represent "open" or "inclusive" language such that they include recited elements but also permit inclusion of additional, unrecited elements.

As used herein, the term "about", in the context of concentrations of components of the formulations, typically means +/−5% of the stated value, more typically +/−4% of the stated value, more typically +/−3% of the stated value, more typically, +/−2% of the stated value, even more typically +/−1% of the stated value, and even more typically +/−0.5% of the stated value.

Throughout this disclosure, certain embodiments may be disclosed in a range format. It should be understood that the description in range format is merely for convenience and brevity and should not be construed as an inflexible limitation on the scope of the disclosed ranges. Accordingly, the description of a range should be considered to have specifically disclosed all the possible sub-ranges as well as individual numerical values within that range. For example, description of a range such as from 1 to 6 should be considered to have specifically disclosed sub-ranges such as from 1 to 3, from 1 to 4, from 1 to 5, from 2 to 4, from 2 to 6, from 3 to 6 etc., as well as individual numbers within that range, for example, 1, 2, 3, 4, 5, and 6. This applies regardless of the breadth of the range.

DETAILED DISCLOSURE OF EMBODIMENTS

Exemplary, non-limiting embodiments of an alloy and a method of forming the same, will now be disclosed.

In one embodiment the alloy has a formula:

$$Zr_{100-X-U}(Cu_{100-a}Ni_a)_XAl_U$$

wherein X, U and a are in atomic percentages in the following ranges:

$37 \leq X \leq 48$, $3 \leq U \leq 14$, and $3 \leq a \leq 30$.

In another embodiment the alloy has a formula:

$$[Zr_{100-X-U}(Cu_{100-a}Ni_a)_XAl_U]_{100-Z}Y_Z$$

wherein X, U, Z and a are in atomic percentages in the following ranges:

$37 \leq X \leq 48$, $3 \leq U \leq 14$, $0 \leq Z \leq 3$, and $3 \leq a \leq 30$.

The atomic percentage X may be in the range selected from the group consisting of: about 37 to about 46; about 37 to about 44; about 37 to about 42; about 37 to about 40; about 38 to about 48; about 40 to about 48; about 42 to about 48; and about 44 to about 48.

The atomic percentage U may be in the range selected from the group consisting of: about 3 to about 12; about 3 to about 10; about 3 to about 8; about 3 to about 6; about 4 to about 14; about 6 to about 14; about 8 to about 14.

The atomic percentage Z may be in the range selected from the group consisting of: about 0 to about 2; about 0 to about 1; about 1 to about 3; and about 2 to about 3.

The combination of copper (Cu) and nickel (Ni) in the alloy can be of a formula $(Cu_{100-a}Ni_a)$ wherein $5 \leq a \leq 15$. The atomic percentage a may be in the range selected from the group consisting of: about 5 to about 14; about 5 to about 12; about 5 to about 10; about 5 to about 8; about 6 to about 14; about 8 to about 14; about 10 to about 14; and about 12 to about 14.

The addition of yttrium may reduce toughness of the alloy, however, this is compromised by an improvement in glass-forming ability of the mixture.

The alloy may comprise an amorphous phase in an amount, in volume percentage, selected from the group consisting of: about 50 to about 100, about 50 to about 90, about 50 to about 80, about 50 to about 70, about 50 to about 60, about 60 to about 100, about 70 to about 100, about 80 to about 100, and about 90 to about 100.

The alloy can be an amorphous matrix composite or a fully amorphous solid. As defined above, the 'amorphous matrix composite' is a material which contains at least 50% by volume of the amorphous phase. The 'fully amorphous solid' contains at least 95% by volume of the amorphous phase. Preferably, the alloy is a bulk metallic glass having a thickness of at least 1 mm.

The method of forming an alloy comprises the steps of:

(a) melting Zr, Cu, Ni and Al in defined amounts to form a molten mixture having a formula:'

$$Zr_{100-X-U}(Cu_{100-a}Ni_a)_XAl_U$$

wherein X, U and a are in atomic percentages in the following ranges:

$37 \leq X \leq 48$, $3 \leq U \leq 14$, and $3 \leq a \leq 30$; and (b) cooling the molten mixture to form the alloy.

Similarly, the method of forming an alloy having yttrium in its composition comprises the steps of:

(a) melting Zr, Cu, Ni, Al and Y in defined amounts to form a molten mixture having a formula:

$$[Zr_{100-X-U}(Cu_{100-a}Ni_a)_X Al_U]_{100-Z} Y_Z$$

wherein X, U, Z and a are in atomic percentages in the following ranges:

$37 \leq X \leq 48$, $3 \leq U \leq 14$, $0 < Z \leq 3$, and $3 \leq a \leq 30$; and (b) cooling the molten mixture to form the alloy.

The melting step (a) may comprise the step of:

(a1) melting the mixture using a plasma arc.

The plasma arc can be generated from an arc electrode, and the heat generated therefrom is capable of melting the mixture, and fusing the constituents of the mixture into a homogeneous molten mixture.

The melting step (a) may also comprise the step of: (a2) transferring the molten mixture to a mould before the cooling step (b). It will be appreciated that the mixture can be melted and cooled in the mould and both steps need not be carried out in two separate locations.

The above methods may further comprise the step of:

(c) ejecting the alloy from the mould.

BRIEF DESCRIPTION OF DRAWINGS

The accompanying drawings illustrate a disclosed embodiment and serves to explain the principles of the disclosed embodiment. It is to be understood, however, that the drawings are designed for purposes of illustration only, and not as a definition of the limits of the invention.

FIG. 5A: 80:20; FIG. 5B: 85:15; FIG. 5C: 90:10; and FIG. 5B: 95:5. The dark areas of the scanned pictures show the amorphous phase of the alloys while the light areas indicate the crystalline phase of the alloys.

BEST MODE

Figure 1:
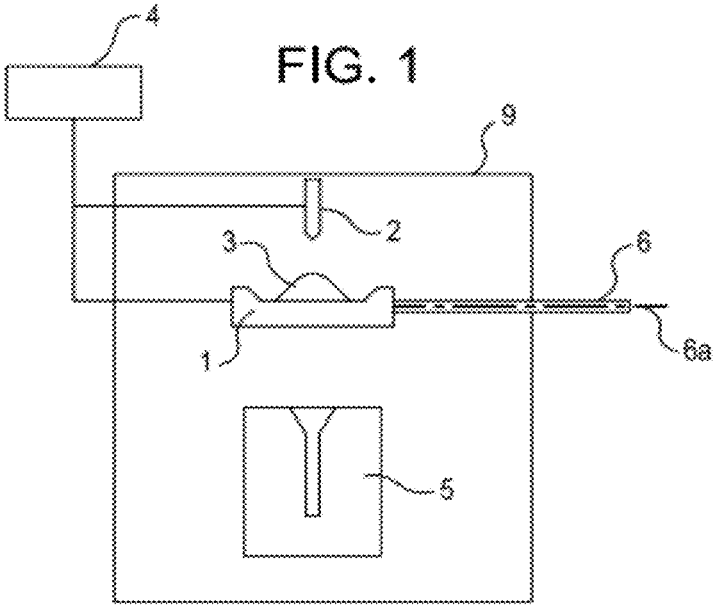
FIG. 1 shows a schematic view of an apparatus for manufacturing an alloy in accordance with an embodiment.

FIG. 1 shows a schematic view of an apparatus for manufacturing the amorphous alloy. The apparatus comprises a vacuum chamber 9 which houses a copper crucible 1, an arc electrode 2, and a copper mould 5. The copper crucible 1 is, mounted onto an arm 6 which can be manually rotated about axis 6*a*.

Figure 2A:
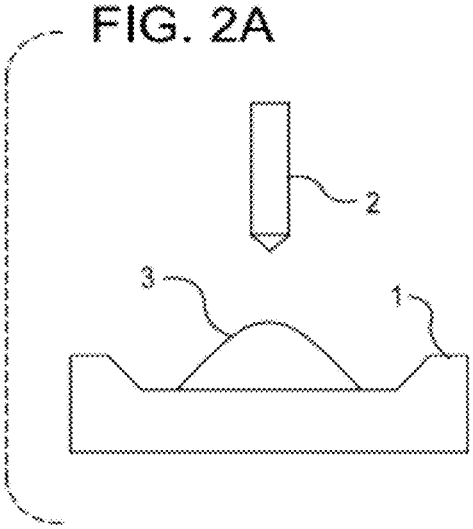
FIGS. 2A-2D show a Manufacturing process for an alloy using the apparatus in FIG. 1.

FIGS. 2A-2D show a manufacturing process for an alloy using the apparatus in FIG. 1. Referring to FIG. 2A, the mixture 3 is placed on the copper crucible 1. The mixture 3 is of a composition expressed by the general formula as defined above. The constituents of the mixture are typically in the form of wires, pellets or an agglomeration of particles. It should be noted that the metals used to make the alloy may comprise incidental impurities. Because the metals used to make the alloy are obtained commercially, they may contain a relatively small amount of impurities.

Figure 2B:
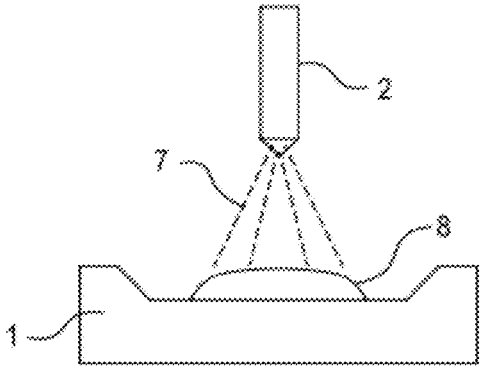

Referring to FIG. 2B, the mixture is exposed to plasma arc 7 generated from the arc electrode 2. The heat generated therefrom melts and fuses the mixture to form a homogeneous molten mixture 8. The cooling water supplier 4 (refer to FIG. 1) circulates and supplies cooled water to the copper crucible 1 to prevent overheating.

Figure 2C:
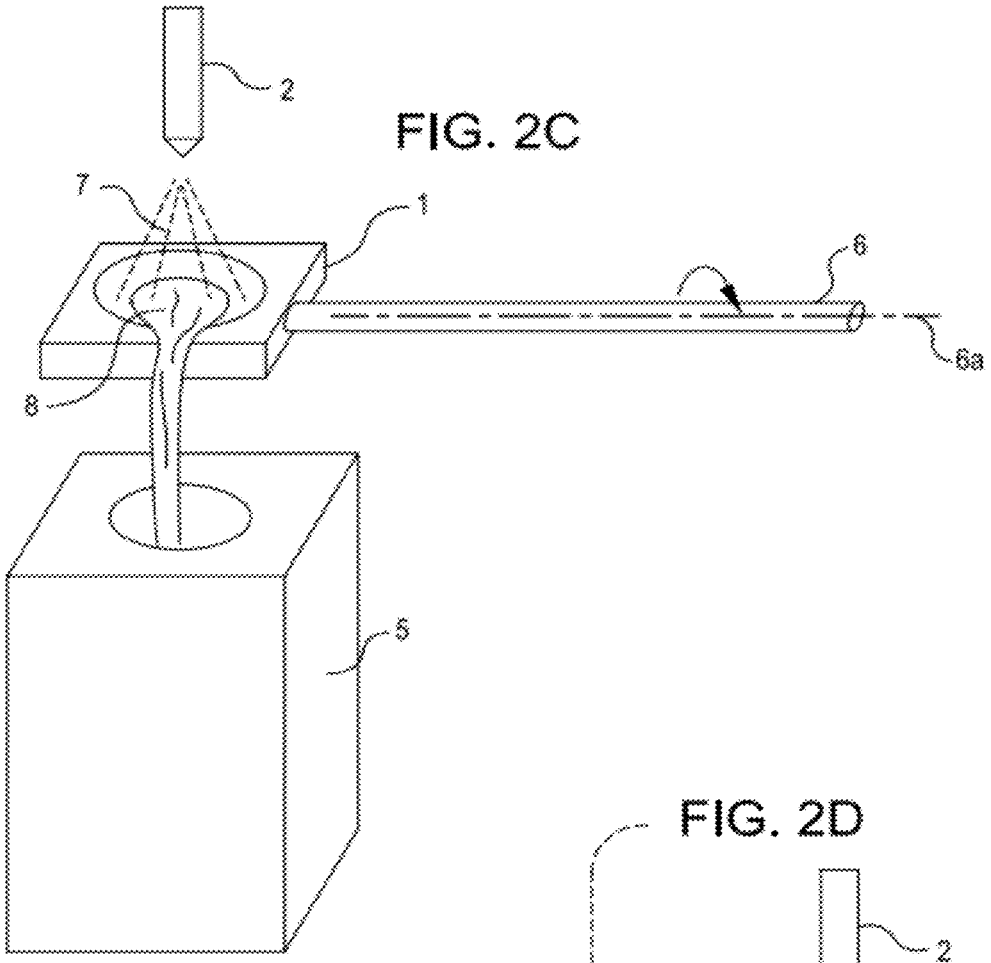

Referring to FIG. 2C, the arm 6 is rotated manually about axis 6*a* such that the copper crucible 1 rotates downwards to pour the molten mixture 8 into the copper mould 5 positioned beneath the Copper crucible 1. The plasma arc 7 is subsequently switched off.

Figure 2D:
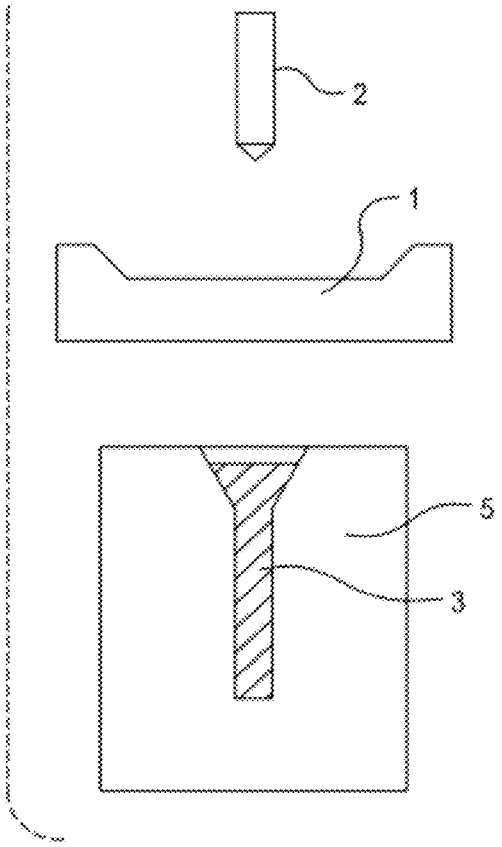

Referring to FIG. 2D, the molten mixture 3 is cooled in the mould 5 to form the alloy. After cooling, the alloy is ejected from the mould.

EXAMPLES

A non-limiting example of the preferred embodiment will be further described in greater detail below, which should not be construed as in any way limiting the scope of the invention.

Example 1

Table 1 shows compositions of mixtures formed in accordance with a disclosed embodiments, and the diameters (or thickness) of rods into which they were moulded.

Each of the rod alloys disclosed in Table 1 were made in the apparatus and the process described above with reference to FIGS. 1 and 2A-D.

Each mixture was prepared by weighing pellets of Zr (99.98% wt), Cu (99.999% wt), Ni (99.98% wt) and Al (99.9%) in weight percentage to achieve the desired atomic percentage shown in Table 1. For example, for alloy 1, a 1 mole sample has a composition of formula $Zr_{50}Cu_{36.45}Ni_{4.05}Al_{9.5}$ as the ratio of Cu to Ni is 90:10. To prepare alloy 1 a mixture of metal pellets was prepared by weighing Zr(99.98% wt), Cu (99.999% wt), Ni (99.98% wt) and Al (99.9%) metal pellets in the following weights:

Zr: 45.612 g

Cu: 23.162 g

Ni: 2.378 g

Al: 2.563 g

The mixture was melted to a molten metal and an alloy formed using the apparatus and method described above with respect to FIGS. 1 and 2A to 2D.

All of the alloys given in Table 1 were produced in the same manner as described above for alloy 1. The proportion of Cu and Ni in the alloys, in atomic percentage, was 90 percent of Cu and 10 percent Ni.

As can be seen from Table 1, a few copper moulds of varying diameters were used. The moulds have cylindrical cavities such that the alloys formed are in the shape of rods. The copper moulds used had cavity diameters of 5 mm, 8 mm, 12 mm, 16 mm and 20 mm as shown in Table 1. The length of the cavity for all of the moulds was 60 mm.

Figure 3:
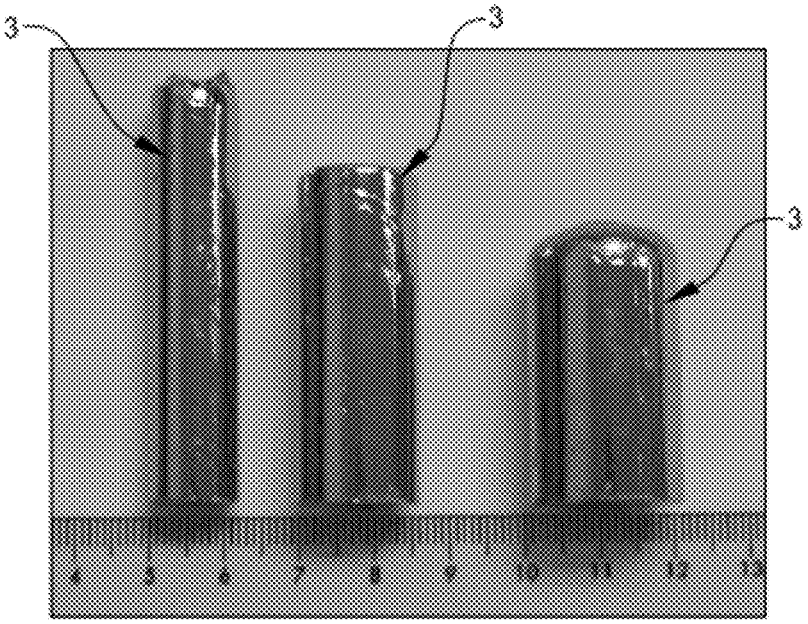
FIG. 3 shows rods formed from an alloy in accordance with an embodiment.

FIG. 3 shows three cast rods (3A, 3B, 3C) respectively having diameters of 12 mm, 16 mm and 20 mm. All of the cast rods (3A, 3B, 3C) were subjected to X-ray diffraction to determine the amorphous content therein. The results of the X-ray diffraction were recorded in the following manner in Table 1:

C: an amorphous matrix composite

A: a fully amorphous solid

Depending on the composition of the mixture 3 and the cavity diameter of the copper mould 5, the cast rods were fully amorphous (A) or amorphous matrix (C) as denoted in Table 1 for each alloy.

The results of the experiment confirmed that the compositions as defined by the embodiments yield alloys having an amorphous phase. More particularly, the alloys of these compositions have at least 50% by volume of an amorphous phase.

TABLE 1

| Alloy | Atomic Percentage | | | | Max. |
|---|---|---|---|---|---|
| Number | Zr | $CU_{90}Ni_{10}$ | Al | Morphology | Thickness (mm) |
| 1 | 50 | 40.5 | 9.5 | C | 20 |
| 2 | 50.5 | 40.75 | 8.75 | C | 20 |
| 3 | 50.5 | 40.5 | 9 | C | 20 |
| 4 | 50.75 | 40.5 | 8.75 | C | 20 |
| 5 | 51 | 40 | 9 | C | 20 |
| 6 | 50.75 | 40.25 | 9 | A | 20 |
| 7 | 51 | 41 | 8 | C | 16 |
| 8 | 50.5 | 41 | 8.5 | C | 16 |
| 9 | 50 | 41 | 9 | C | 16 |
| 10 | 49.5 | 41 | 9.5 | C | 16 |
| 11 | 51.5 | 40 | 8.5 | C | 16 |
| 12 | 50.5 | 40 | 9.5 | C | 16 |
| 13 | 49 | 41 | 10 | C | 16 |
| 14 | 51 | 40.5 | 8.5 | C | 16 |
| 15 | 50.25 | 40.75 | 9 | C | 16 |
| 16 | 50.25 | 40.5 | 9.25 | C | 16 |
| 17 | 51 | 40.25 | 8.75 | C | 16 |
| 18 | 50.5 | 40.25 | 9.25 | C | 16 |
| 19 | 49.5 | 40.5 | 10 | C | 16 |
| 20 | 49.5 | 40.75 | 9.75 | C | 16 |
| 21 | 50 | 40 | 10 | C | 16 |
| 22 | 50 | 42 | 8 | C | 12 |
| 23 | 49.5 | 42 | 8.5 | C | 12 |
| 24 | 50.5 | 41.5 | 8 | C | 12 |
| 25 | 49 | 42 | 9 | C | 12 |
| 26 | 50 | 41.5 | 8.5 | C | 12 |
| 27 | 49.5 | 41.5 | 9 | C | 12 |
| 28 | 52 | 41 | 7 | C | 12 |
| 29 | 51.5 | 41 | 7.5 | C | 12 |
| 30 | 49 | 40.5 | 10.5 | C | 12 |
| 31 | 49.5 | 40 | 10.5 | C | 12 |
| 32 | 49 | 44 | 7 | C | 8 |
| 33 | 49 | 43 | 8 | C | 8 |
| 34 | 50.5 | 43 | 6.5 | C | 8 |
| 35 | 51 | 43 | 6 | C | 8 |
| 36 | 53 | 42 | 5 | C | 8 |
| 37 | 52 | 42 | 6 | C | 8 |
| 38 | 51 | 42 | 7 | C | 8 |
| 39 | 50.5 | 42 | 7.5 | C | 8 |
| 40 | 50 | 43 | 7 | C | 8 |
| 41 | 49 | 46 | 5 | C | 5 |
| 42 | 49 | 40 | 11 | C | 5 |

Figure 4:
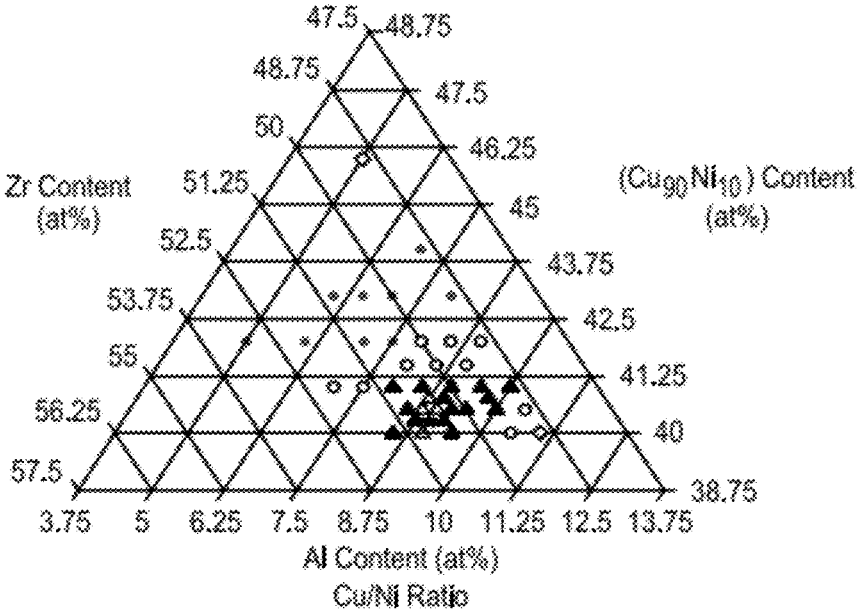
FIG. 4 shows a quasi-ternary composition phase diagram indicating a glass forming region and a composite forming region of an alloy in accordance with an embodiment.
Figure 5A:
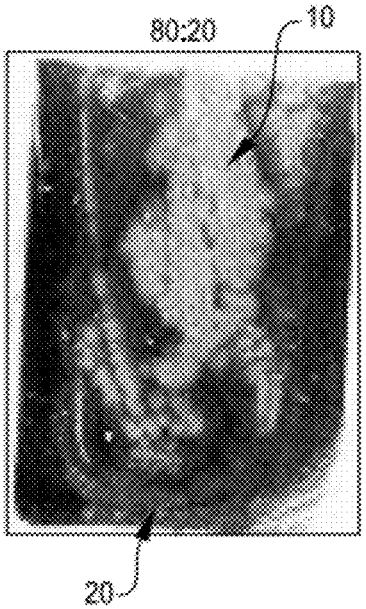
FIGS. 5A, 5B, 5C and 5D are scanned pictures of alloys in accordance with one embodiment and having Cu:Ni ratios as follows.
Figure 5B:
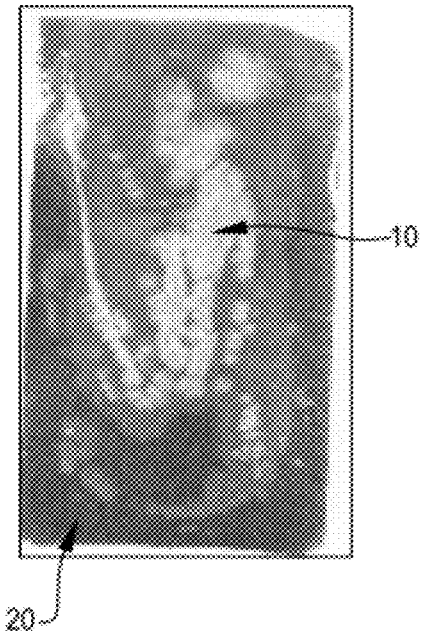
Figure 5C:
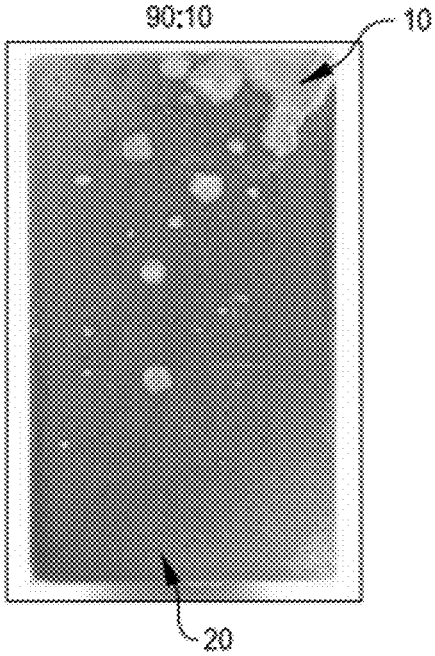
Figure 5D:
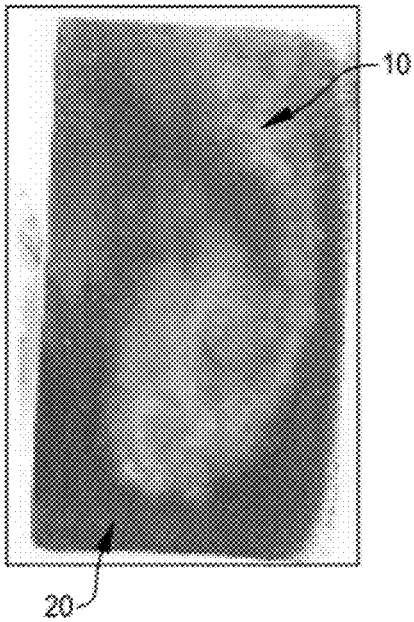

FIG. 4 shows a fraction of a quasi-ternary phase diagram of the data obtained from Table 1. The lower left apex represents 57.5 atomic percent Zr and 3.75 atomic percent Al. The upper apex represents 48.75 atomic percent of a mixture of Cu and Ni and 47.5 atomic percent of Zr. In this diagram, the proportion of mixture of Cu and Ni, in atomic percentage, was 90 percent of Cu and 10 percent Ni. Similarly, the lower right apex represents 13.75 percent of Al and 38.75 percent of the mixture of Cu and Ni.

Since the cavity diameters of the copper mould were confined to 5, 8, 12, 16 and 20 mm, these diameters were used to determine the maximum size that a particular alloy composition after casting is still a composite. For example, if a 16 mm diameter cast rod of a composition (M) showed that it is a composite, and 20 mm diameter cast rod of the same composition (M) showed that it is a crystalline material, the maximum size of the cast rods for composition (M) such that it is still a composite was determined to be 16 mm. It should be realised that the maximum size might be bigger, i.e., a larger than 16 mm but below 20 mm.

Referring to FIG. 4, the compositions are characterised in into the following compositions:

- alloys that remain as composites having a diameter of 5 mm (represented by open squares);
- alloys that remain as composites having a diameter of 8 mm (represented by closed circles);
- alloys that remain as composites having a diameter of 12 mm (represented by open circles);
- alloys that remain as composites having a diameter of 16 mm (represented by closed triangles);
- alloys that remain as composites having a diameter of 20 mm (represented by open triangles); and
- alloys that form amorphous solids having a diameter of 20 mm (represented by solid stars).

The above data as plotted on the phase diagram defines the glass forming region. The best glass forming region is defined by the solid star which indicated a composition capable of forming an amorphous solid at a diameter of 20 mm. It will be appreciated that at least one of the compositions can produce an amorphous solid at a diameter of 20 mm. As can be seen from Table 1, the composition comprises about 50.75 percent zirconium, about 40.25 percent copper and nickel mixture and 9 percent of aluminum.

FIGS. 5A, 5B, 5C and 5D each show a scanned micrograph of an alloy having a composition 50 atomic weight percent of Zr, 42 atomic weight percent copper and nickel mixture, and 8 atomic weight percent aluminum. The Cu:Ni ratio for the alloy in FIG. 5A was 80:20; the Cu:Ni ratio for the alloy in FIG. 5B was 85:15; the Cu:Ni ratio for the alloy in FIG. 5C was 90:10; and the Cu:Ni ratio for the alloy in FIG. 5D was 95:5. The dark areas 10 indicate the amorphous phase and the light areas 20 indicate the crystalline phase. The alloys having the Cu:Ni ratio of 90:10 and 95:5 had more of the amorphous phase than the alloys having the Cu:Ni ratio of 80:20 and 85:15.

APPLICATIONS

It will be appreciated that the alloy composition and bulk metallic glass composition does not contain beryllium which is a carcinogen. Accordingly, beryllium Poisoning can be avoided and post-processing costs can be reduced.

It will be appreciated that an amorphous matrix composite or a fully amorphous solid can be obtained at diameters above 20 mm for the alloy composition as disclosed in the embodiments.

It will be appreciated that the alloy, and bulk metallic glass disclosed herein, like VITRELOY™ 1, can be used extensively in a wide number of applications, which includes sports and luxury products, electronic goods, medical instruments and military equipment.

It will be apparent that various other modifications and adaptations of the invention will be apparent to the person skilled in the art after reading the foregoing disclosure without departing from the spirit and scope of the invention and it is intended that all such modifications and adaptations come within the scope of the appended claims.

The invention claimed is:

1. A quasi-ternary alloy consisting of Zr, Cu, Ni and Al metals, wherein the quasi-ternary alloy has the following formula: $Zr_{50.75}(Cu_{90}Ni_{10})_{40.25}Al_9$.

2. A quasi-ternary alloy according to claim 1, comprising an amorphous phase in an amount, in volume percentage, of about 50 to about 100.

3. A bulk metallic glass consisting of Zr, Cu, Ni and Al metals, wherein said metals are present in said bulk metallic glass to form a quasi-ternary alloy according to the formula: $Zr_{50.75}(Cu_{90}Ni_{10})_{40.25}Al_9$.

4. A bulk metallic glass according to claim 3, wherein at least 50% of said quasi-ternary alloy is in an amorphous phase.

* * * * *